US008438961B2

(12) United States Patent
Repac

(10) Patent No.: US 8,438,961 B2
(45) Date of Patent: May 14, 2013

(54) KITCHEN SLICER

(76) Inventor: Cedomir Repac, Brechen (DE)

( * ) Notice: Subject to any disclaimer, the term of this patent is extended or adjusted under 35 U.S.C. 154(b) by 605 days.

(21) Appl. No.: 12/595,076

(22) PCT Filed: Aug. 21, 2008

(86) PCT No.: PCT/DE2008/075004

§ 371 (c)(1),
(2), (4) Date: Oct. 8, 2009

(87) PCT Pub. No.: WO2009/103255

PCT Pub. Date: Aug. 27, 2009

(65) Prior Publication Data

US 2010/0037471 A1 Feb. 18, 2010

(30) Foreign Application Priority Data

Feb. 18, 2008 (DE) ..... 20 2008 002 233 U

(51) Int. Cl.
*B26D 1/02* (2006.01)

(52) U.S. Cl.
USPC ..... 83/440.2; 83/856

(58) Field of Classification Search ..... 83/856, 83/240, 247, 707, 440.2, 441
See application file for complete search history.

(56) References Cited

U.S. PATENT DOCUMENTS

| | | | | |
|---|---|---|---|---|
| 4,570,519 | A * | 2/1986 | Motosko, II | 83/856 |
| 4,624,166 | A * | 11/1986 | Kreth et al. | 83/699.51 |
| 4,733,588 | A * | 3/1988 | Yamamoto | 83/857 |
| 5,001,835 | A * | 3/1991 | Boerner | 30/278 |
| 5,765,472 | A * | 6/1998 | Kim | 99/537 |
| 5,947,016 | A | 9/1999 | Repac et al. | |
| D416,767 | S | 11/1999 | Repac et al. | |
| 6,129,234 | A | 10/2000 | Culig et al. | |
| 6,209,439 | B1 | 4/2001 | Repac et al. | |
| 6,401,605 | B1 | 6/2002 | Repac et al. | |
| 6,732,622 | B2 * | 5/2004 | Vincent | 83/247 |
| 6,805,044 | B1 * | 10/2004 | Yamamoto | 99/537 |
| 7,107,890 | B2 * | 9/2006 | Vincent | 83/247 |
| 7,150,214 | B2 | 12/2006 | Repac et al. | |

(Continued)

FOREIGN PATENT DOCUMENTS

| | | |
|---|---|---|
| CN | 2255797 Y | 6/1997 |
| DE | 10328506 B4 | 1/2005 |
| EP | 0306017 B1 | 3/1989 |
| WO | WO-0236312 A1 | 5/2002 |

OTHER PUBLICATIONS

International Search Report in International Patent Application PCT/DE2008/075004, mailed on Apr. 6, 2009.

*Primary Examiner* — Sean Michalski
(74) *Attorney, Agent, or Firm* — Leydig, Voit & Mayer, Ltd.

(57) ABSTRACT

In order to set the cutting thickness in kitchen slicers, it is a known procedure to arrange a feed plate at a slant relative to the blade. As an alternative, solutions are known according to which the feed plates are changed so that a suitable feed plate is provided for each cutting thickness that can be set. The objective of the invention is to provide a simple alternative. Towards this end, the invention proposes that the feed plate (11) can be moved surface-parallel to a fixed plate (12) that is connected to the blade (13). This movement can be effectuated by means of a combination of vertical and horizontal movements of the feed plate and of a positioning slide (14) associated with said feed plate.

22 Claims, 4 Drawing Sheets

U.S. PATENT DOCUMENTS

| | | | | |
|---|---|---|---|---|
| D576,454 | S | 9/2008 | Repac | |
| 7,444,909 | B2 | 11/2008 | Repac et al. | |
| D59,115 | S | 4/2009 | Repac | |
| 7,621,207 | B2 * | 11/2009 | Botsai et al. | 83/698.11 |
| 7,690,285 | B2 * | 4/2010 | de Buyer | 83/247 |
| 7,694,615 | B2 * | 4/2010 | DiPietro | 83/425.3 |
| 7,712,402 | B2 * | 5/2010 | Ishii | 83/13 |
| 2004/0200366 | A1 * | 10/2004 | Koerselman et al. | 99/537 |
| 2004/0231482 | A1 * | 11/2004 | Boilen | 83/425.3 |
| 2005/0028685 | A1 * | 2/2005 | Yamamoto | 99/537 |
| 2005/0178262 | A1 | 8/2005 | Repac et al. | |
| 2006/0075872 | A1 * | 4/2006 | Wangler | 83/856 |
| 2006/0283299 | A1 * | 12/2006 | Mellen et al. | 83/401 |
| 2007/0089577 | A1 * | 4/2007 | Wong | 83/13 |
| 2009/0044708 | A1 | 2/2009 | Repac et al. | |
| 2009/0078100 | A1 | 3/2009 | Repac | |
| 2011/0067545 | A1 * | 3/2011 | Robbins | 83/698.71 |
| 2011/0132161 | A1 * | 6/2011 | Robbins | 83/13 |

* cited by examiner

KITCHEN SLICER

CROSS-REFERENCE TO RELATED APPLICATIONS

This application is a national stage application (under 35 U.S.C. §371) of PCT/DE2008/075004, filed Aug. 21, 2008, which claims benefit of German application 20 2008 002 233.9, filed Feb. 18, 2008.

DESCRIPTION

The present invention relates to a kitchen slicer comprising a slicer frame with a feed plate, a fixed plate and a blade, whereby the blade is arranged between the feed plate and the fixed plate, it is affixed to the fixed plate, and the front edge of the feed plate is offset with respect to the blade by a selectable cutting thickness.

BACKGROUND AND STATE OF THE ART

Such a kitchen slicer is previously known from German patent specification DE 103 28 506 B4. The problem of setting the cutting thickness is remedied by the solution presented there in that the kitchen slicer comes with several different feed plates that are interchangeable. Each individual feed plate establishes a specific cutting thickness so that a different cutting thickness can be achieved by changing a feed plate or by turning a feed plate.

Generally speaking, such kitchen slicers are used to process fruit and vegetables, a procedure in which sliding the food over a blade cuts the food into slices. For this purpose, a feed plate is provided on which the food is pushed towards the blade. The feed plate is positioned lower than the blade so that a gap that is the same size as the cutting thickness is created between the feed plate and the blade. The blade is arranged on a fixed plate on which the sliding movement of the food continues beyond the blade. In addition to the above-mentioned possibility of changing the cutting thickness, it is likewise a known procedure to configure the feed plate at a slant in such a way that a greater slant translates into a greater cutting thickness.

SUMMARY OF THE INVENTION

Before the backdrop of this state of the art, the present invention has an objective of putting forward a kitchen slicer that provides an alternative option for varying the cutting thickness.

According to one aspect of the invention, a kitchen slicer having a slicer frame is provided that allows the feed plate to be moved so as to remain parallel to the fixed plate. This parallel movement can allow the food to move straight towards the blade, which results in a more uniform cutting of the food. Moreover, this is particularly advantageous when a food holder is employed since the holder can always be held parallel to the two plates, which makes it easier to guide the food holder. Such a movement of the feed plate should especially be stepless so that the desired cutting thickness can be selected at will.

This can be done, for instance, by means of a height-adjustment guide provided in the slicer frame above the feed plate. In particular, the height-adjustment guides are configured in such a way that the feed plate can be repositioned in the height-adjustment guide perpendicular to the pushing direction of the food. Here, a guide in the form of grooves is provided which is arranged vertically in the slicer frame. The height-adjustment guides thus configured are closed off especially towards the blade (top), thereby defining the highest setting position for the feed plate. In the opposite direction, however, the height-adjustment guides are advantageously open, so that the feed plate can be removed, for instance, in order for the device to be cleaned. The feed plate has height-adjustment tabs so as to engage with the height-adjustment guides, thereby ensuring a reliable and uniform guidance.

The device is augmented in that a positioning slide is associated with the feed plate. Such a positioning slide has several sliding surfaces on which the feed plate is mounted so as to slide. Here, the sliding surfaces are positioned at a slant so that a lateral movement of the positioning slide relative to the feed plate also causes a movement of the latter. The feed plate has corresponding runners that can be placed onto the sliding surfaces. In a particularly advantageous manner, the sliding surfaces of the positioning slide are folded over and these folded-over edges run in matching grooves of the feed plate. As a result, the feed plate can be carried along upwards as well as downwards by the positioning slide.

Grooves are likewise associated with the positioning slide that runs in these grooves, but this is a lateral guide that is now arranged horizontally relative to the vertical height-adjustment guide of the feed plate. Therefore, if the positioning slide is moved along the lateral guide, then it presses against the feed plate, with the result that the feed plate—which is mounted so that only its height can be changed—can now only deflect upwards or downwards. Due to the runners or the sliding surfaces and the folded-over edges, a certain force is exerted onto the feed plate, so that a movement of the positioning slide in one direction raises the feed plate, while a movement in the opposite direction lowers the feed plate.

Accordingly, the positioning slide likewise has means in the form of lateral guide tabs that engage in the lateral guide. In contrast to the guide for the feed plate, the lateral guides, of course, cannot be open towards the bottom, which is why they have an insertion guide for inserting the lateral guide tabs into the lateral guides. It is via these lateral guides that the positioning slide can be returned to its original position after being cleaned.

In a particularly advantageous manner, the positioning slide can be attached to the feed plate by means of a bolt that can engage—for instance, by being screwed in or clamped on—with a bolt catch arranged on the feed plate. The bolt, which clamps the positioning slide against the feed plate, defines the relative position between the feed plate and the positioning slide, and thus, owing to the corresponding runners or rails, also establishes the position of the arrangement as a whole in the slicer frame. The cutting thickness can be varied by releasing the bolt and moving the positioning slide into another desired position. As an alternative to this, the bolt can be in the form of an adjustment screw that, when it is turned, moves the positioning slide in the appertaining direction.

By the same token, however, the feed plate can be connected to the positioning slide via an eccentric adjustment knob. For this purpose, an eccentric suspension is shaped on the feed plate and it goes through the positioning slide. Another suspension part is arranged directly on the positioning slide. Turning the eccentric adjustment knob—which is joined to both suspension parts—causes the two elements to move with respect to each other. The eccentric adjustment knob can have a graduated scale that provides information about the cutting thickness that is currently set.

In a special or alternative embodiment, the feed plate can be moved upwards to such an extent that said feed plate covers the blade. This is a preferred storage position since the blade is thus covered in such a way as to avoid accidental cutting with the blade, that is to say, for instance, injury to the user.

The kitchen slicer can advantageously be used with a food holder that has a food chamber to accommodate the food to be sliced. The holder provides a gripping surface so that the user does not move the food itself over the blade, but rather only the appertaining food holder. This has the advantage that the user's fingers do not move closer to the blade as some of the food is cut off upon contact with the blade since this would entail the risk that the user's fingers might touch the blade.

In this vein, at least on its side facing the blade, the food holder has a projection on the wall surface that constitutes a protective shield that protects the fingers from the blade.

In order to likewise achieve a uniform guidance of the food holder, especially in order to ensure that the food holder does not strike against the blade, the food holder also advantageously runs in a guide groove into which it can be inserted using a guide edge. In order to ensure that the food holder is always placed onto the slicer frame properly during use of the food holder—especially in order to make it clear that the food holder may only be used in the direction of the provided guide grooves—directional arrows that indicate the proper direction of movement can be printed or embossed onto the food holder.

Particularly when it comes to a food holder that is held in a guide groove, it is practical for the holder to have a removable lid. In this case, the food to be sliced can also be inserted via the removable lid into the food holder or into the food chamber so that it is not necessary to disengage the food holder from its guide every time a new piece of food is to be sliced. In an advantageous manner, holding means, especially a holding plate, are associated with the lid, and said means can be retracted into the food chamber from the lid side. By means of this holding plate, which advantageously has teeth, spikes or the like, the food can be held in place inside the food chamber, so that here as well, it is possible to achieve a well-defined cut. The holding plate is preferably pressed against the food by a pressure spring, so that the food likewise cannot slip upwards towards the space in the food chamber, said spacing becoming larger as more and more of the food is processed.

Moreover, the bottom of the food chamber can have a cutout that runs through the center point of the food chamber. This allows the food holder to be used for elongated types of food that are to be sliced, for instance, carrots, which otherwise cannot be inserted into a food holder that is, for example, round in shape. Therefore, thanks to the cutout, even such foods can be centered.

The food holder very advantageously has gripping surfaces along its circumference with which the user can more firmly grip the food holder. Appropriately shaped surfaces which, when properly handled, are situated in the area of the user's fingertips, prevent the fingers from slipping when the food holder is being moved, thus increasing the convenience of use.

It is likewise possible for the food chamber to be at least partially transparent, in other words, to be made of a transparent plastic, so that the user can see into it from the outside.

Advantageously, the bottom of the kitchen slicer has at least one support shoulder by means of which the kitchen slicer can be placed onto the edge of a bowl that is to be filled, whereby very advantageously, the support shoulder is configured so that it can be removed if so desired.

DESCRIPTION OF THE DRAWINGS

The invention described above will be explained in greater detail below on the basis of embodiments and with reference to the accompanying drawings in which.

DETAILED DESCRIPTION OF EMBODIMENTS

Figure 1:
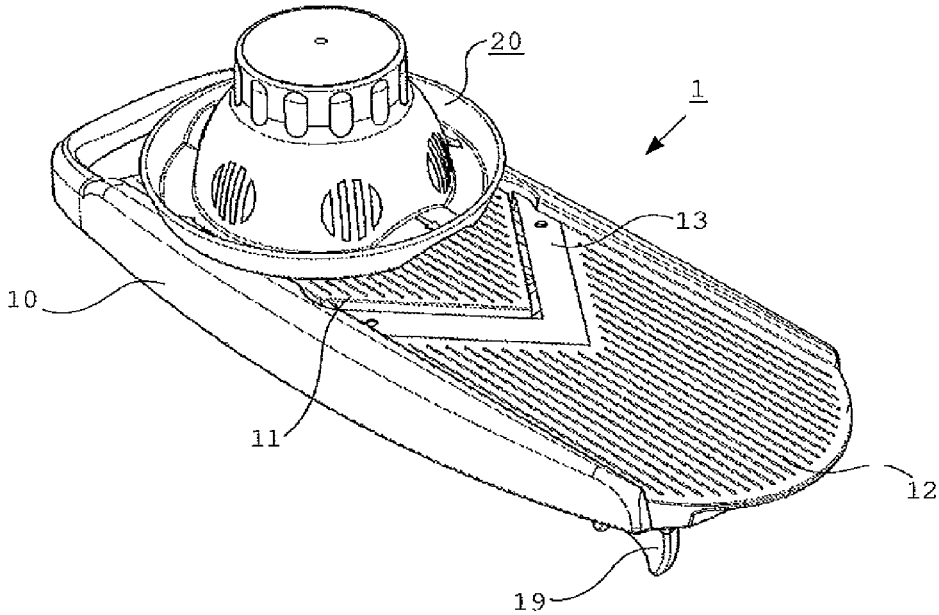
FIG. 1—a kitchen slicer having a slicer frame and a food holder, in a perspective view at a slant from above.

FIG. 1 shows a kitchen slicer 1 consisting of a slicer frame 10 and a food holder 20. In order for a piece of food to be processed, the food is placed into the food holder 20, which has a food chamber 21 for this purpose. The slicer frame 10 has a feed plate 11 as well as a fixed plate 12, between which a blade 13, preferably V-shaped, is arranged. In this context, the feed plate 11 is arranged below the blade 13 in such a way that the food that is being moved on the feed plate 11 towards the blade 13 strikes the blade 13, a process in which it is sliced by the latter. In order to allow a desired cutting thickness to be set, the feed plate 11 can be moved steplessly surface-parallel to the fixed plate 12 on which the piece of food from which a slice has been cut off continues to move beyond the blade 13. The slice of the food that has been cut off falls below the fixed plate 12 into a bowl (not shown) situated, for example, underneath the kitchen slicer 1. For this purpose, the bottom of the kitchen slicer 1 has a support shoulder 19 that can be removed if necessary but which, in the arrangement shown in FIG. 1, serves to rest on the edge of a bowl (not shown).

Figure 2:
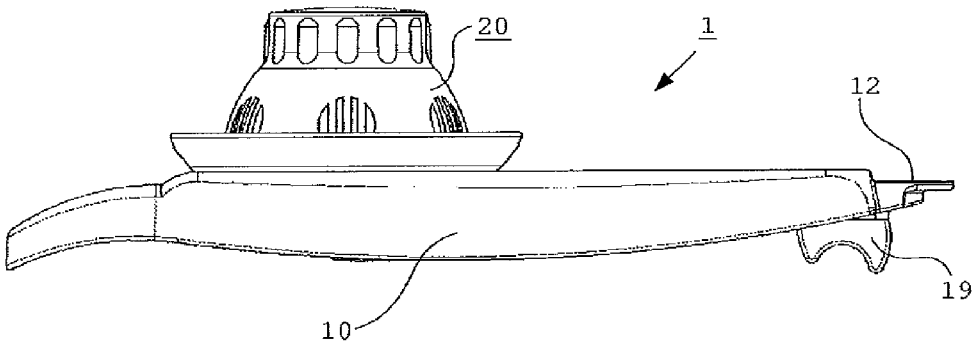
FIG. 2—the kitchen slicer according to FIG. 1, in a plan side view.

FIG. 2 shows the kitchen slicer 1 in a side view. The kitchen slicer 1 with the food holder 20 can be seen here, although the kitchen slicer 1 can certainly also be used without the food holder 20. In this case, the holder is removed from its guide in which it normally runs along the surface of the kitchen slicer 1 in the slicer frame 10, and the food can be pushed as desired over the blade 13, also by hand.

Figure 3:
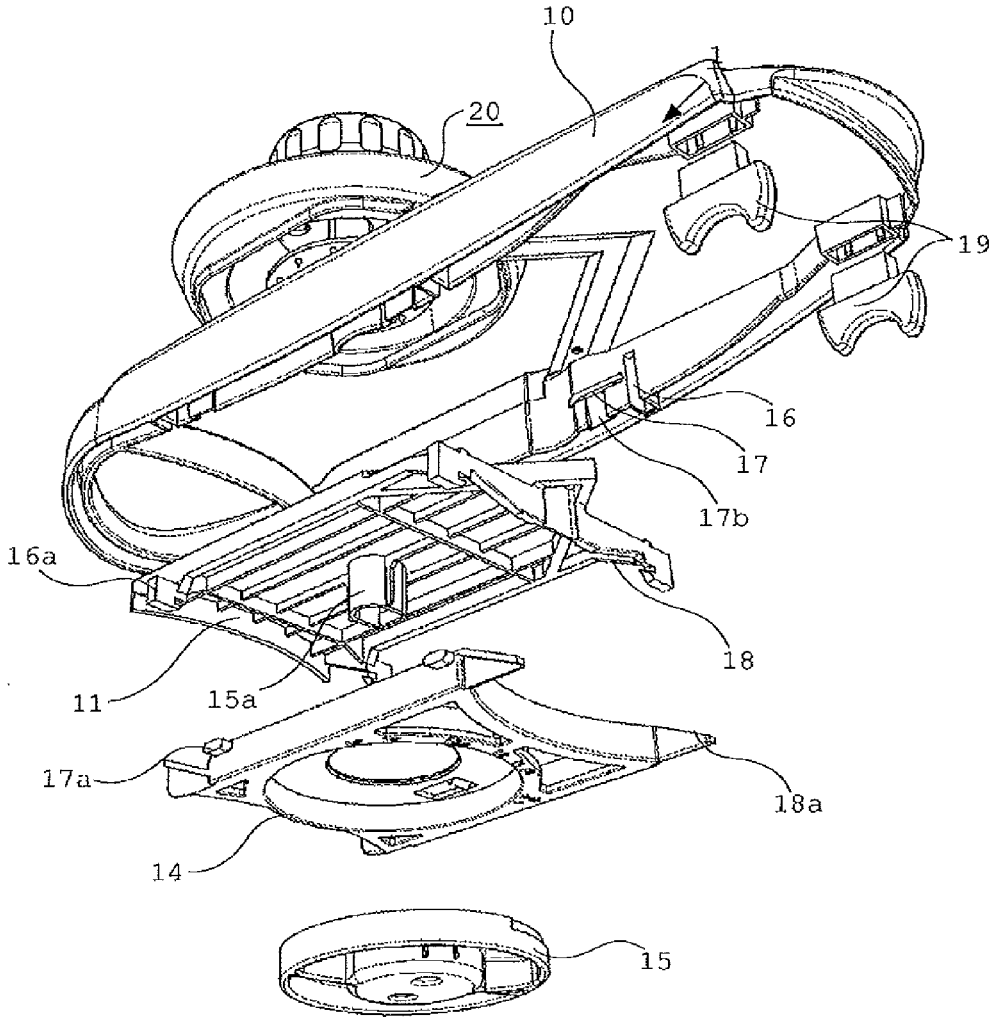
FIG. 3—the kitchen slicer according to FIG. 1, in an exploded perspective view at a slant from below.

FIG. 3 shows the structure of the kitchen slicer 1 in the form of an exploded view. Here, it can be seen that the feed plate 11 is movably mounted in the slicer frame 10 by means of height-adjustment guides 16. Matching height-adjustment tabs 16*a* on the feed plate 11 engage into the height-adjustment guides 16, so that the feed plate 11 is prevented from deflecting in any direction other than in the vertical direction. Once the feed plate 11 has been put in place, it is followed by a positioning slide 14 which, in turn, runs in a lateral guide 17. The positioning slide 14 has a plurality of sliding surfaces 18*a* that match corresponding runners 18 on the feed plate 11. If the positioning slide 14 is then pressed against the feed plate 11, which is done by inserting the guide tabs 17*a* into the lateral guide 17, then the runners 18 of the feed plate 11 rest firmly on the corresponding sliding surfaces 18*a* of the positioning slide 14. The latter is held in the lateral guide 17, in other words, it, in turn, can only deflect in a lateral direction. If the positioning slide 14 is moved, for instance, towards the blade, the feed plate 11 cannot follow such a movement since it is laterally affixed. For this reason, the feed plate 11 will deflect upwards due to force exerted by the sliding surfaces 18*a* onto the runners 18. In the opposite direction, a folded-over edge of the sliding surface 18*a*—which engages with matching grooves in the area of the runners 18 of the feed plate 11—ensures that the feed plate 11 will be carried along when the positioning slide 14 is moved in the other direction.

The positioning slide can be affixed, for example, by means of an eccentric adjustment knob 15 that is connected via an eccentric suspension 15*a* to the feed plate 11 and to the positioning slide 14.

Figure 4:
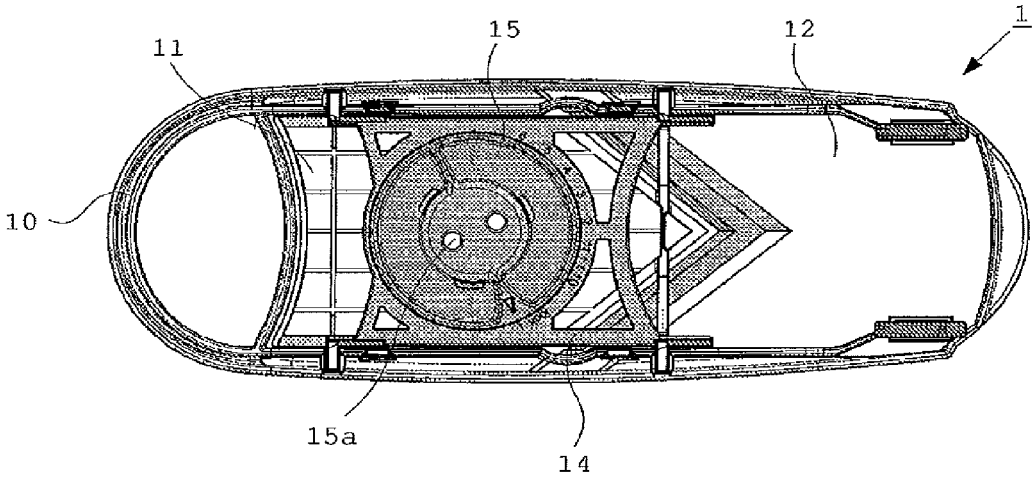
FIG. 4—the kitchen slicer according to FIG. 1, in a plan view from the bottom.

In this context, FIG. 4 shows a plan view from the bottom of the kitchen slicer 1 in which the eccentric adjustment knob 15 is set to a "lock" position. In this position, the feed plate 11 is set beyond the height of the blade 13 so that the blade 13 is concealed behind the feed plate 11. This prevents injury to a user due to accidental contact with the blade 13. If the eccentric adjustment knob 15 is then turned to the left, owing to the eccentric suspension 15*a*, the feed plate 11 and the positioning slide 14 move with respect to each other in such a way that the feed plate 11 is lowered with respect to the blade 13. A graduated scale has been applied around the eccentric adjustment knob 15, and said scale provides information about the cutting thickness that is currently set.

Figure 5:
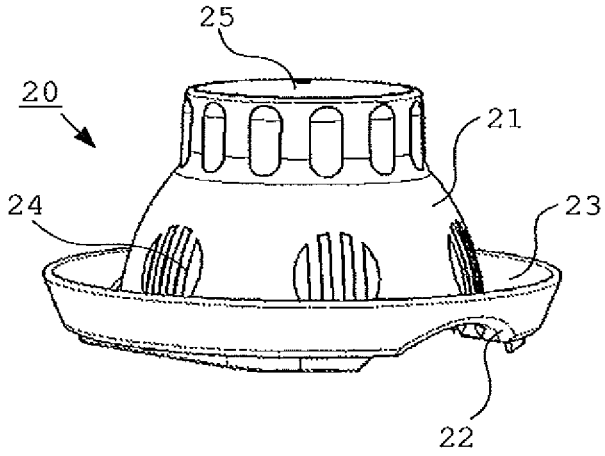
FIG. 5—a food holder in a perspective view, at a slant from the front.

FIG. 5 shows a food holder 20 that has a semispherical food chamber 21. The food holder 20 has a projection 23 that forms a protective shield for the user's fingers. Thanks to such a projection, the fingers can be kept outside of the area of the blade 13, that is to say, the fingers are covered by the projection 23. When the slicer is being used properly, the user holds the food holder by a grip 25 that has several gripping surfaces 24 and moves it back and forth over the slicer frame. In this process, the user can check the current filling level in the food chamber 21 of the food holder 20 since the outer wall is made of transparent plastic. Moreover, the food holder 20 has a cutout 22 in the area of its bottom which is provided in order to accommodate elongated types of food that are to be sliced. In this manner, the device can also be used to slice foods that cannot be accommodated in the food chamber.

Figure 6:
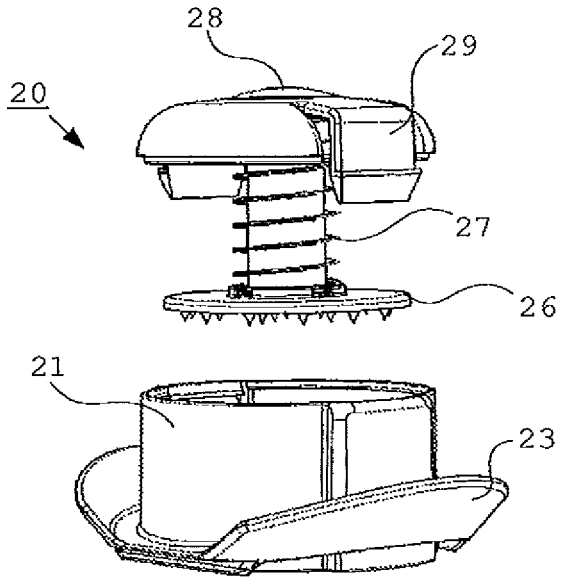
FIG. 6—an alternative food holder in a exploded perspective view, at a slant from above.

FIG. 6 shows an alternative food holder 20 that has a removable lid 28. This lid 28 has a holding plate 26 that is provided with teeth. These teeth pierce the food being held in the food holder 20, so that the food is secured with respect to the lower surface. This allows a clean cut of the food, which is also pushed over the blade 13 with a certain amount of force. The holding plate is supported by means of a pressure spring 27 so that the holding plate 26 can extend downwards as the food continues to be sliced. The lid 28 can be secured with a closure 29 so that here as well, a closed food chamber 21 is formed.

Above, a kitchen slicer is described that allows the feed plate to be raised and lowered uniformly, thus ensuring that the food can be sliced uniformly.

While preferred embodiments of the invention have been described and illustrated here, various changes, substitutions and modifications to the described embodiments will become apparent to those of ordinary skill in the art without thereby departing from the scope and spirit of the invention.

LIST OF REFERENCE NUMERALS

1 kitchen slicer
10 slicer frame
11 feed plate
12 fixed plate
13 blade
14 positioning slide
15 eccentric adjustment knob
15*a* eccentric suspension
16 height-adjustment guide
16*a* height-adjustment tab
17 lateral guide
17*a* lateral guide tab
17*b* insertion guide
18 runners
18*a* sliding surfaces
19 support shoulder
20 food holder
21 food chamber
22 cutout
23 projection
24 gripping surfaces
25 grip
26 holding plate
27 pressure spring
28 lid
30 closure

The invention claimed is:

1. A kitchen slicer, comprising:

a slicer frame with a feed plate, a fixed plate and a blade that is arranged between the feed plate and the fixed plate and affixed to the fixed plate, wherein the front edge of the feed plate facing the blade is offset with respect to the blade by a selectable cutting thickness, and wherein the feed plate is mounted so as to be movable relative to the fixed plate wherein the feed plate has height-adjustment tabs that run in height-adjustment guides of the slicer frame and that allow a surface-parallel movement of the feed plate, and wherein the feed plate has sloping runners that are mounted so as to slide on corresponding sloping sliding surfaces of a positioning slide, and the positioning slide has lateral tabs by means of which the positioning slide is mounted so as to slide in lateral guides with respect to the slicer frame perpendicular to the direction of movement of the feed plate.

2. The kitchen slicer according to claim 1, wherein the height-adjustment guides are restricted in the direction of movement towards the blade.

3. The kitchen slicer according to claim 1, wherein the sliding surfaces have folded-over edges that are held in the runners in the form of a guide.

4. The kitchen slicer according to claim 1, wherein the lateral guides have an insertion guide for inserting the lateral guide tabs into the lateral guides.

5. The kitchen slicer according to claim 1, wherein the positioning slide can be attached to the feed plate by means of a bolt that is screwed into or clamped onto a bolt catch on the feed plate.

6. The kitchen slicer according to claim 1, further comprising an eccentric adjustment knob that is joined to the feed plate and to the positioning slide via an eccentric suspension in such a way that, turning the eccentric adjustment knob causes a relative movement between the feed plate and the positioning slide.

7. The kitchen slicer according to claim 1, wherein the height-adjustment guides or lateral guides are configured as grooves in the slicer frame.

8. The kitchen slicer according to claim 1, wherein the feed plate can be raised above the blade, thereby concurrently covering said blade.

9. The kitchen slicer according to claim 1, further comprising a food holder with a food chamber to accommodate food that is to be sliced.

10. The kitchen slicer according to claim 9, wherein the food holder has a protective shield that is preferably configured in the form of a projection on a wall surface of the product holder.

11. The kitchen slicer according to claim 9, wherein the slicer frame has a guide groove for the food holder into which it can be inserted using a guide edge.

12. The kitchen slicer according to claim 11, wherein directional arrows are printed or embossed onto the food holder and serve to indicate the proper direction of movement of the food holder.

13. The kitchen slicer according to claim 9, wherein the food holder has a removable lid.

14. The kitchen slicer according to claim 9, wherein the food holder has a holding plate that can be retracted into the food chamber.

15. The kitchen slicer according to claim 14, wherein the holding plate is pressed by a pressure spring against the food placed into the food chamber.

16. The kitchen slicer according to claim 14, wherein the holding plate has teeth that secure the food in the food chamber.

17. The kitchen slicer according to claim 9, wherein the bottom of the food chamber that slides on the feed plate has a cutout that runs through a center point of the food chamber.

18. The kitchen slicer according to claim 9, wherein the food holder has gripping surfaces to improve the contact between a user's hand and the food holder.

19. The kitchen slicer according to claim 9, wherein the food chamber is at least partially transparent.

20. The kitchen slicer according to claim 1, wherein the kitchen slicer has at least one support shoulder.

21. The kitchen slicer according to claim 20, wherein the support shoulder is detachable.

22. The kitchen slicer according to claim 1, wherein the blade is V-shaped.

* * * * *